United States Patent [19]

Johnson

[11] Patent Number: 4,619,021

[45] Date of Patent: Oct. 28, 1986

[54] CLOSURE STRIP TO BE APPLIED TO BAGS

[76] Inventor: James R. Johnson, 3819 Greenhill Dr., Chamblee, Ga. 30341

[21] Appl. No.: 633,219

[22] Filed: Jul. 23, 1984

[51] Int. Cl.[4] ..... B65D 77/10

[52] U.S. Cl. ..... 24/30.5 P; 24/30.5 S; 24/389; 24/427; 206/274; 383/63

[58] Field of Search ..... 24/30.5 P, 30.5 R, 30.5 S, 24/30.5 T, 30.5 L, 389, 427; 292/318, 319, 320, 321, 322; 53/138 A; 206/260, 274, 343; 383/63

[56] References Cited

U.S. PATENT DOCUMENTS

| | | | |
|---|---|---|---|
| 2,008,314 | 7/1935 | Russell | 24/30.5 R |
| 2,107,216 | 2/1938 | Rogers | 206/274 |
| 2,353,858 | 7/1944 | Tedesco | 24/427 |
| 3,233,821 | 2/1966 | Ehlers | 24/30.5 S |
| 3,291,177 | 12/1966 | Naito | 383/63 |
| 3,654,049 | 4/1972 | Ausnit | 24/16 PB |
| 3,659,776 | 5/1972 | Suominen | 24/30.5 L |
| 3,727,829 | 4/1973 | Hüni | 24/30.5 R |
| 4,407,082 | 10/1983 | Stehouwer | 24/30.5 T |

FOREIGN PATENT DOCUMENTS

| | | | |
|---|---|---|---|
| 2907631 | 9/1979 | Fed. Rep. of Germany | 24/389 |
| 1483652 | 4/1967 | France | 383/63 |
| 97451 | 12/1961 | Norway | 383/63 |
| 2117351 | 10/1983 | United Kingdom | 383/63 |

*Primary Examiner*—Victor N. Sakran

*Attorney, Agent, or Firm*—James B. Middleton

[57] ABSTRACT

A closure strip, or zipper, for plastic bags or the like, in which the zipper is to be applied to bag material to form zipper bags. A generally conventional zipper configuration is used, and the mounting flanges for mounting the zipper to the bag material are formed thinner than the body of the zipper to reduce the difference in thickness between the mounting flange and the bag material. Additionally, the inner edges of the inner mounting flanges are tapered so the mounting flanges merge gently into the bag material, allowing uniform welding of the side seam of the bag, the material flowing smoothly to prevent holes in the side welds of the completed bag.

2 Claims, 3 Drawing Figures

10
11
12
14
15
16
18
19
20
21
22
24
25
26
28
29
30
31
32
34
35
36
38
39
40
41
42

CLOSURE STRIP TO BE APPLIED TO BAGS

INFORMATION DISCLOSURE STATEMENT

It is well known in the art to provide mating members of a resilient material such as polyethylene or other thermoplastic material for providing a closure for bags and the like. The two methods by which such closures are fixed to bags include the extrusion of the bag material together with the closure members, and the extrusion of closure members alone to be later applied to plastic film to be formed into a bag.

When the closure members and the bag material are extruded together, the closure members and the bag itself may be of any thickness desired without causing undue problems since the closure will be integrally formed with the bag material. On the other hand, when the closure members are to be later applied to plastic film in order to make bags, it will be understood that additional problems are introduced in that the thermoplastic material of the closure members must be thermally welded to the thermoplastic bag material. It is well known that the welding of materials having vastly different thicknesses is difficult to achieve, and especially while maintaining the required standards of an attractive seam without degradation of the thinner material. In the conventional technique, the bag material will begin as a continuous sheet and the closure members will be applied to the continuous sheet, then the continuous material will be cut and sealed laterally of the sheet to provide discrete bags. Since the closure members are usually relatively thick, it is very difficult to achieve a good seam in the side seals of the bag in the vicinity of the closure member. While the seam may admit of only a pinhole or the like, such bags are frequently used for materials wherein even a pinhole is fatal to the contents.

SUMMARY OF THE INVENTION

This invention relates generally to closure strips and the like, and is more particularly concerned with a closure strip, or plastic zipper, to be subsequently applied to bag material for forming zipper bags.

The present invention provides mating closure strips wherein a generally conventional zipper configuration is provided with mounting flanges that are substantially thinner than the zipper. The mounting flanges are of generally uniform thickness, and extend towards the lip of the bag, one mounting flange stopping short of the other to allow convenience in opening the bag. The mounting flanges extend in the opposite direction, into the bag, and also extend unequally so the two mounting flanges will not terminate at the same point in the side seam of the bag. In addition, the mounting flanges directed inwardly of the bag are feathered, or tapered, in order to merge smoothly and completely into the side seam of the bag. In one embodiment of the invention, the mounting flanges have a thickness of approximately ten thousandths of an inch, and the mounting flanges taper to an edge having a radius of approximately one thousandth of an inch. The mounting flange can therefore be cut and sealed laterally of the bag material, and the tapering of the zipper material will allow a complete, impervious weld on the side seam.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figures 1, 2, 3:
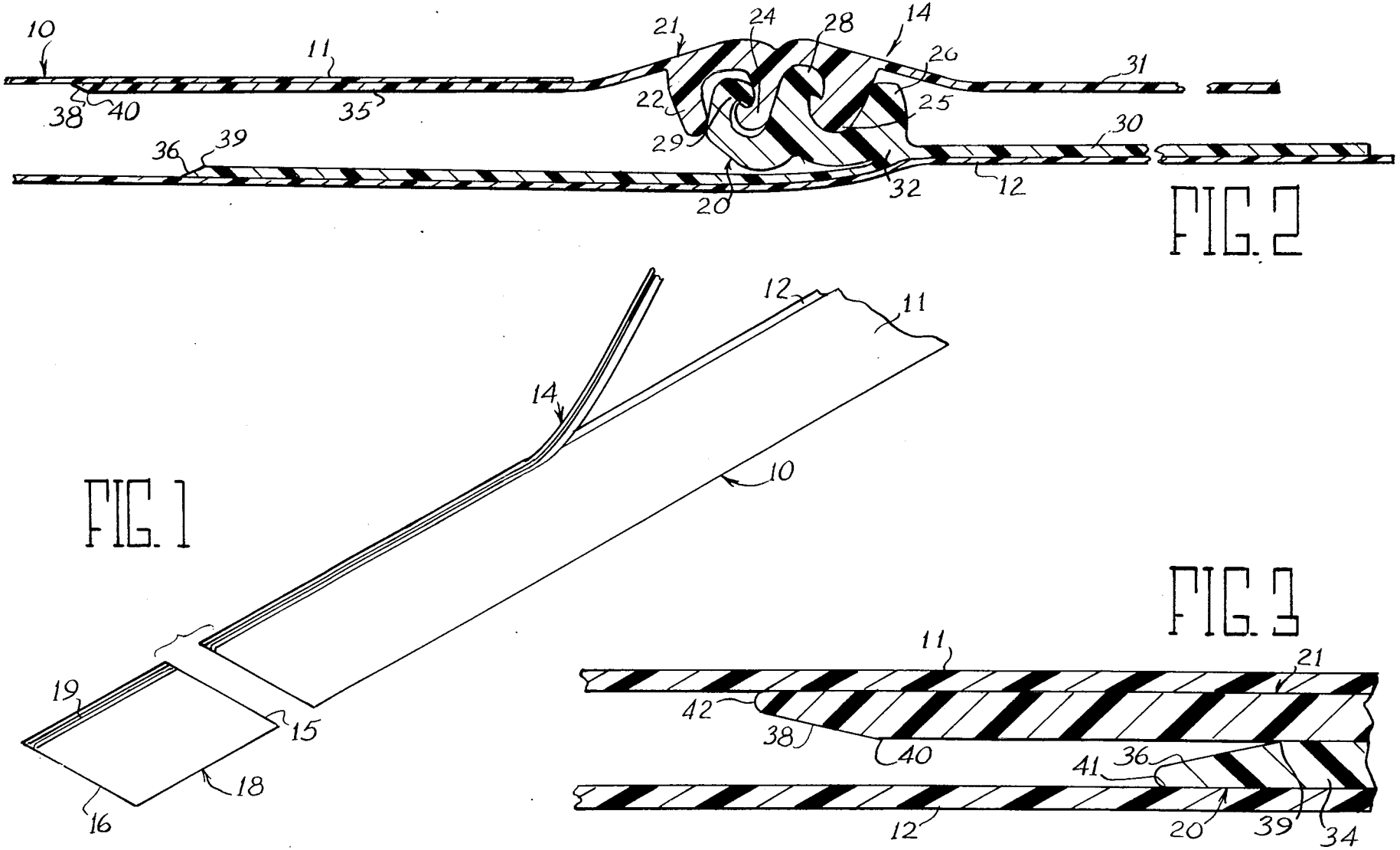
FIG. 1 is a somewhat schematic perspective view showing continuous bag material with a continuous closure strip being applied thereto.
FIG. 2 is an enlarged cross-sectional view showing the two members of the closure strip made in accordance with the present invention, and showing the closure strips interengaged and attached to the bag material; and, FIG. 3 is a further enlarged view illustrating the tapering of the inner edge portions of the closure strip to merge with the bag material for welding of the side seam.

Referring now more particularly to the drawings, and to that embodiment of the invention here presented by way of illustration, FIG. 1 shows generally a strip of sheet material folded for forming bags, this sheet material, or bag material, being designated at 10, the bag material 10 including a front panel 11 and a rear panel 12. As is conventional in the art, the closure strip 14 has the mating members interengaged, and the closure strip 14 is placed between the front 11 and back 12 and is appropriately sealed to the bag material 10. Following sealing of the closure strip 14 into the bag material 10, the entire assembly is cut and sealed transversely along the lines indicated at 15 and 16, thereby providing a completed bag 18 with a selectively closeable opening 19.

Looking now at FIG. 2 of the drawings, it should first be understood that the particular closure configuration for the interengaging members themselves is known in the art; and, while the particular configuration is the one preferred, other configurations will work quite well.

Considering the particular closure member shown in FIG. 2 in more detail, it will be seen that the closure member which is generally designated at 14 includes a rear closure strip 20 and a front closure strip 21 for attachment to the back and front 12 and 11 of the bag material 10 respectively. The particular closure member here illustrated includes a pressure member 22 adjacent to two hook members 24 and 25, all carried by the front strip 21 and forming a part thereof.

The back strip 20 is similar, and includes a pressure member 26 having two hook members 28 and 29. Those skilled in the art will understand that the hook member 29 is receivable between the pressure member 22 and the hook member 24, the pressure member 22 urging the hook member 29 into engagement with the hook member 24. Simultaneously, the hook member 38 is inserted between the hook member 24 and the hook member 25, and the pressure member 26 urges the hook member 25 into engagement with the hook member 28.

The closure strip 20 has a mounting flange 30 that extends towards the top of the bag, and the closure strip 21 has a mounting flange 31 that extends towards the top of the bag. It will be seen that the mounting flange 31 is shorter than the mounting flange 30 so the upper edges of the bag will be vertically separated to allow easy opening.

With the above in mind, it will be seen that the closure member 20 has the hooks 28 and 29, along with the pressure member 26, formed integrally, but carried by the mounting flange at a hinge line 32. The mounting flange 34 of the closure member 20 then extends towards the bottom of the bag, and is moveable with respect to the main body of the closure member. The closure member 21 has a mounting flange 35 extending towards the bottom of the bag, and the body of the closure member is completely fixed to the mounting flanges 31 and 35 so there is no relative movement between the hook members and the mounting flanges.

With the above in mind, it will be seen that, when the flanges 34 and 35 are urged apart, the hooks 28 and 29 of the closure member 21 will tend to remain engaged with the hooks 24 and 25 of the closure member 21, the mounting flange 34 simply pivoting with respect to the hooks at the hinge line 32. However, when the flanges 30 and 31 are pulled apart, the closure members themselves are substantially immediately urged apart. The result is that a bag made with a closure member of this type is difficult to open from the inside of the bag, but is relatively easy to open from the outside of the bag. The bag carrying the closure member as shown in FIG. 2 is therefore designed to withstand considerable internal pressures.

The extreme ends of the mounting flanges 34 and 35 are tapered as shown at 36 and 38. It is contemplated that the mounting flanges 34 and 35 will be of substantially uniform thickness from the body of the closure member to the break point 39 or 40. The mounting flange will then taper downwardly to an edge as thin as is reasonably possible.

Those skilled in the art will understand that, in the extruding of members such as those shown in FIG. 2, one generally uses a radius rather than a precise angle since the material will flow more smoothly. For this reason, the extreme ends designated at 41 and 42 will be rounded rather than as a knife edge.

It will be noticed that, with the closure strips 20 and 21 interengaged, the mounting flange 31 stops short of the mounting flange 30 to provide an easy opening lip between the two. Looking at the opposite flanges, flanges 34 and 35 of the closure strip 14, the flange 34 has its extreme end 41 so located as to stop before the break 40 of the flange 35. As the closure strip 14 is applied to the bag material 10, the various pieces will lie somewhat as indicated in FIG. 3.

When the individual bags 18 are severed from the sheet material and sealed along their edges 15 and 16, the action is normally achieved in a single operation through the use of a side sealing blade. The side sealing blade is a heated blade that is pressed into the thermoplastic material, the blade extending completely across the bag material 10 with the closure strip 14 attached. It is only the side surface of the side sealing blade that has the opportunity to melt the thermoplastic material and provide a complete weld along the sides 15 and 16.

Using the conventional closure strips, the mounting flanges such as the flanges 34 and 35 are generally quite thick, perhaps around 8 mils in thickness. These flanges then terminate with square ends. It is in this area that pinholes develop when one is using the conventional closure strips. From the foregoing it should be understood that, especially with relatively thin sheet material as the bag material, the bag material will be melted to the point of degradation in order to effect a reasonable seal between the parts of the closure strip. This degradation, in conjunction with the large, abrupt steps from the closure strip to the bag material causes holes.

Looking now particularly at FIG. 3 of the drawings, it will be seen that the mounting flange 34 is tapered towards the back 12 of the bag. The flange 34 terminates in a rounded end 41, but it will be understood that the abrupt step is removed, so the mounting flange 34 can flow smoothly into the bag material. Similarly, the mounting flange 35 is tapered towards the front 11 of the bag, and the flange 35 terminates in a rounded end 42. Again, the abrupt step is removed and the material can flow smoothly for a uniform weld.

It will also be understood that FIG. 3 illustrates the parts in their natural shape; however, one must remember that the materials involved are somewhat elastomeric. As a result, when the side sealing blade engages the materials, the various layers 12, 34, 35 and 11 will be distorted to lie generally contiguously. It is in this contiguous position that heat will be applied, and all layers of the material can flow to form a weld without interruptions and without holes.

Though closure strips and bag materials will vary considerably, it is contemplated that the mounting flanges 30, 31, 34 and 35 of the closure strip 14 will have a thickness in the vicinity of 4 mils, whereas the closure members themselves may have a thickness in the vicinity of 15 mils. The thickness of the mounting flanges 34 and 35 then tapers at 36 and 38 to an end 41 and 42 having a radius of approximately 1 mil. While the distance of the taper can also vary considerably, a feathering over a distance of around 10 mils has been found to be effective.

It will therefore be understood by those skilled in the art that the present invention provides a closure strip of the type to be subsequently applied to bag material, the closure strip having relatively thin mounting flanges, and the mounting flanges tapering to merge gently into the bag material.

With this gentle merging of all layers of material, at the time the assemmbly is side sealed all layers of the material are completely welded together to assure a good side seam with no degradation of the bag material and no pinholes or the like.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A bag formed of thermoplastic sheet material having a closure strip at the top of said bag for selectively closing said bag, said closure strip being formed of a substantially thicker material than said sheet material of said bag, said closure strip including a rear closure member for attachment to the back panel of said sheet material and a front closure member for attachment to the front panel of said sheet material, said rear closure member and said front closure member being interengageable with each other, said rear closure member including an upper mounting flange extending towards the top of said bag and a lower mounting flange extending towards the bottom of said bag, said front closure member including an upper mounting flange extending towards the top of said bag and a lower mounting flange extending towards the bottom of said bag, said lower mounting flange of said front closure member extending beyond said lower mounting flange of said rear closure member when said rear closure member and said front closure member are interengaged, said lower mounting flange of said front closure member defining a beveled edge for allowing said lower mounting flange to merge smoothly into said front panel of said sheet material so that said sheet material of said bag can flow smoothly into the material of said closure in spite of the differences in thickness of said sheet material of said bag and said closure, said lower mounting flange of said rear closure member defining a beveled edge for allowing said lower mounting flange to merge smoothly into said rear panel of said sheet material, and further characterized in that said beveled edge on said lower mounting flange of said front closure member begins beyond said lower mounting flange of said rear closure member, the arrangement being such that the plurality of layers comprising said rear panel of said sheet material, said lower mounting flange of said rear closure member, said lower mounting flange of said front closure member and said front panel of said sheet material all merge smoothly for allowing an imperforate weld of said thermoplastic material at said closure strip.

2. A bag as claimed in claim 1, said beveled edge extending over a distance of approximately ten mils and tapering from the thickness of said lower mounting flange to an edge having a radius of approximately one mil.

* * * * *